United States Patent [19]

Schenker

[11] 4,178,753

[45] Dec. 18, 1979

[54] PENDANT COMPRISING A SLEEVE IN COMBINATION WITH A TIMEPIECE

[75] Inventor: Emil Schenker, Grenchen, Switzerland

[73] Assignee: Sorna Watch S.A., Grenchen, Switzerland

[21] Appl. No.: 937,718

[22] Filed: Aug. 29, 1978

[30] Foreign Application Priority Data

Sep. 7, 1977 [CH] Switzerland ..... 10916/77
Feb. 15, 1978 [CH] Switzerland ..... 1651/78

[51] Int. Cl.[2] ..... G04B 47/00
[52] U.S. Cl. ..... 58/152 R
[58] Field of Search ..... 58/88 E, 98, 88 R, 95 R, 58/152 R

[56] References Cited

U.S. PATENT DOCUMENTS 1,549,909 8/1925 Cotler ..... 58/88 R
1,709,700 4/1929 Wishinsky ..... 58/88 R

FOREIGN PATENT DOCUMENTS 704214 5/1931 France .
352297 8/1930 United Kingdom ..... 84/152 R

*Primary Examiner*—Gene Z. Rubinson
*Assistant Examiner*—John B. Conklin
*Attorney, Agent, or Firm*—Berman, Aisenberg & Platt

[57] ABSTRACT

There is disclosed a pendant comprising a sleeve, to which a writing implement may be attached, in combination with a timepiece. The invention provides an arrangement whereby the timepiece, when the pendant is worn around the neck, is readable in the correct position. The timepiece has a housing which is removably connected to the sleeve by means of a plurality of detents. One of the gaps between the detents is wider than the remainder, a projection fits in the sleeve for the reception of a clip in this wider gap, the sleeve has two opposed apertures for pulling through a necklace-type strip and the wider gap fits into the sleeve in the position such that the timepiece is always read in the correct position.

7 Claims, 5 Drawing Figures

PENDANT COMPRISING A SLEEVE IN COMBINATION WITH A TIMEPIECE

The present invention relates to a pendant comprising a sleeve, to which a writing implement, more especially a ballpoint pen, may be attached, in combination with a timepiece.

Such pendant-type timepieces combined with a ballpoint pen are advantageous especially for nursing personnel and for service personnel, more especially barmaids, waitresses and waiters, since such a timepiece permits reading the time should both hands be full while a ballpoint or fountain pen is always available.

U.K. Pat. No. 352297 describes a timepiece which is screwed to the cap of a fountain pen. Since the conventional cap of a fountain pen generally has a small diameter, only small timepieces, which are difficult to read the time from, can be used and it is generally necessary for the dial to be magnified by means of a lens. Also, as it is difficult to align the timepiece relative to the clip due to the screw thread arrangement the timepiece generally has to be additionally secured by means of a lateral screw. French Pat. No. 704,214 moreover discloses a timepiece which may be secured either by being screwed on, or secured by means of a lateral screw, to the cap, whereby the cap is opened out conically. The production of such caps with timepieces, however, is costly and does not lead to a favourably priced product.

It is an object of the present invention to provide a pendant comprising a sleeve in combination with a timepiece, to which sleeve a writing implement may be attached, in which the timepiece is readily removable and whereby the timepiece can always be read in the right position and which moreover is economical to produce.

According to the present invention there is provided a pendant comprising a sleeve, to which a writing implement, more especially, a ballpoint pen may be attached, in combination with a timepiece, in which the timepiece has a housing which, by means of detents is removably connected to the sleeve, wherein one of the gaps between the detents is wider than the remainder and in which a projection fits in the sleeve for the reception of a clip in this wider gap, and in which the sleeve has two opposed apertures for pulling through a necklace-type strip and in which the wider gap and the apertures for the necklace-type strip are so arranged that the timepiece, when worn around the neck, is readable in the correct position.

The present invention will now be further illustrated, by way of example, with reference to the accompanying drawings, in which.

Figure 1:
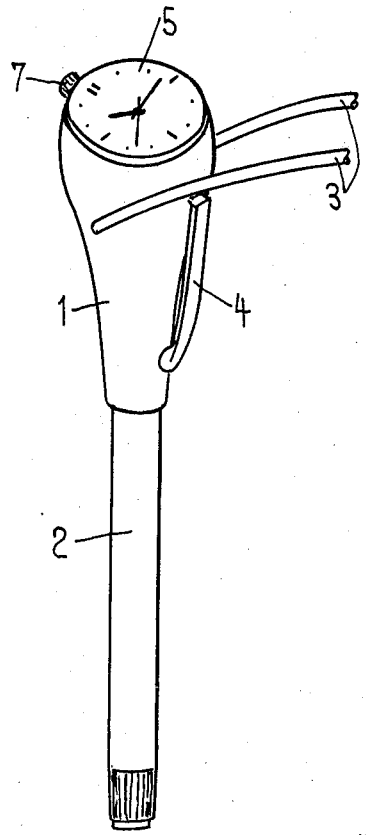
FIG. 1 shows a pendant comprising a sleeve, with inserted ballpoint pen, combined with a timepiece.
Figure 2:
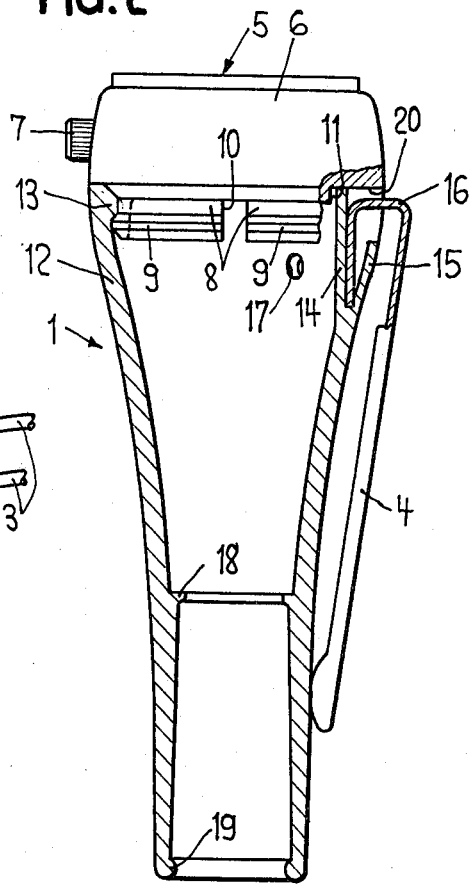
FIG. 2 shows, in longitudinal section, a pendant comprising a sleeve combined with a timepiece.
Figure 3:
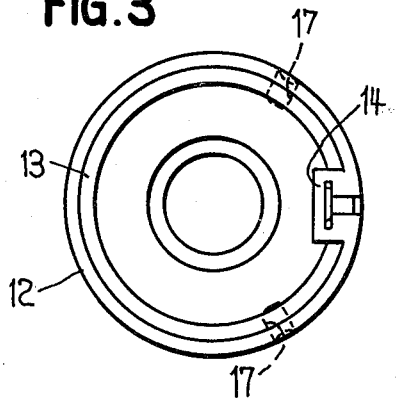
FIG. 3 shows a plan view of the sleeve of FIG. 2.

FIG. 1 shows a sleeve 1, a ballpoint pen 2, a leather strip 3, a clip 4 for attachment and a watch 5. The watch 5 is located in a plastics material housing 6 from which the knurled winder 7 projects, which winder is located at twelve o'clock. The housing 6 has four detents 8 which have a thickening 9 at their ends. Gap 11 between two adjacent detents 8 is wider than the remainder of the gaps 10 and is located opposite the winder. The sleeve part 12 has a substantially conical shape and, at the top, serves to receive the watch 5 with the housing 6, and, at the bottom, serves for the reception of the ballpoint pen 2. At the upper end of the sleeve part 12 there is a bead 13 behind which the thickened portion 9 of the locking or securing detents 8 engages, whereby a secure fit of the watch housing 6 on the sleeve part 12 is ensured. To secure the clip 4, which serves for the attachment of the sleeve to a garment or the like, a projection 14 is located in the sleeve part 12. The outer wall 15, closing the projection 14, does not quite extend to the upper edge of the sleeve part 12, so that the upper portion 16 of the clip 4 is countersunk relative to the upper edge of the sleeve part 12. This permits the insertion of a screwdriver or the like between the upper clip portion 16 and the watch housing 6 to lift off the housing. The drawing also shows that the clip 4, once the housing 6 is removed, is readily removable, while with the housing 6 attached, the clip is prevented from falling out. The sleeve part 12 moreover has two opposed apertures 17 for pulling through a leather thong or the like, whereby the connecting line between the two apertures is at right angles to the connecting line between the winder 7 and the clip 4.

The wider gap 11 which is located opposite the winder, whereby the latter is mounted at 12 o'clock, fits around the projection 14 whereby the dial of the watch is always accurately aligned and thus in such a manner that the watch, in the attached state, can always be correctly read. The same correct readability is also provided by the aforesaid location of the apertures for the necklace-type thong. For securing the ballpoint pen 2, the sleeve part 12 has encircling projections 18 and 19, whereby the projection 18 is formed substantially below the centre and serves for the reception of the rear end portion of the ballpoint pen, while the projection 19, mounted on the rear end portion of the sleeve part 12, serves for the reception of the front portion of the ballpoint pen, as shown in FIG. 1. For this purpose, the ballpoint pen 2 substantially at one third the length of the pen, seen from the ballpoint tip, may have an encircling groove into which the encircling projection 19 engages, while the securing of the ballpoint pen at its rear end is attained by its conicity.

Figure 4:
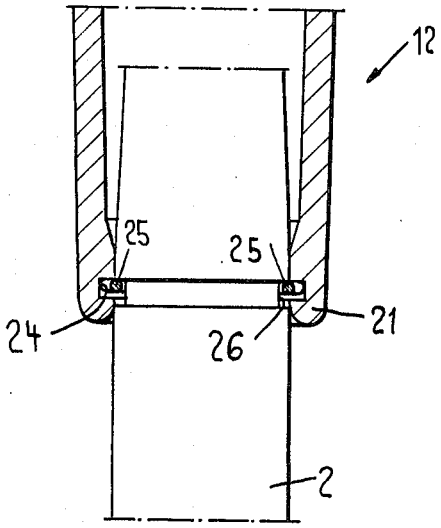
FIG. 4 shows a longitudinal section through a further embodiment of the sleeve part.
Figure 5:
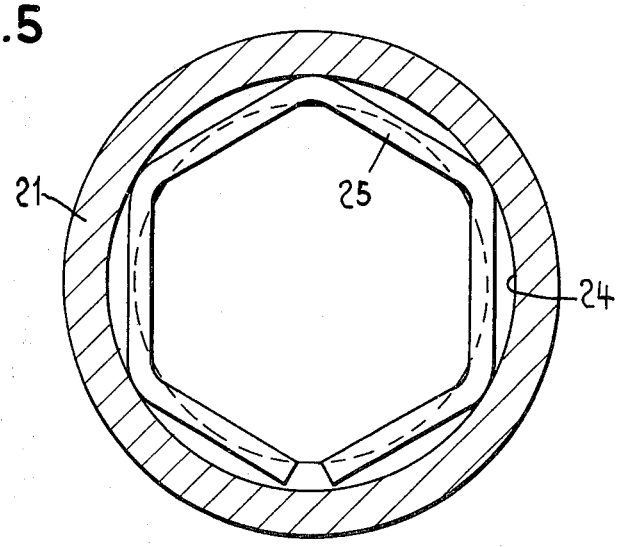
FIG. 5 shows a section through the sleeve of FIG. 4.

FIGS. 4 and 5 show an alternative embodiment, in which the writing implement to an increased extent is prevented from falling out, since it has been found that after frequent use the resilience of the plastics material of the sleeve 1 decreases.

In FIG. 4 there is shown the lower, thickened end 21 of the sleeve part 12 in which the writing implement 2, for example a ballpoint pen, is inserted. An encircling groove 24 is formed in the thickened end 21 into which a polygonal spring 25 is inserted. This, for example, hexagonal spring is open to facilitate its insertion. As shown more especially in FIG. 5, the sides of the spring project from the groove, whereby these are able to engage in a groove 26 in the ballpoint pen, whereby the latter is prevented from falling out. It is self-evident that the polygonal spring may have more or less corners and need not necessarily be open.

The above-described arrangement permits various advantages to be attained. It is possible for the two critical parts of such a sleeve to be readily replaced and more especially, the watch together with the housing, can be readily packaged and dispatched should repairs or replacement be required. Besides this technical aspect the purchaser or the retailer has considerable combination possibilities in that the watch housing, the sleeve part and the ballpoint pen may be made and retailed in different colours which may be optionally combined. By properly selecting the detents for connecting the watch part with the sleeve part due to the wider gap, which fits into the recess for the clip, the watch is constantly aligned and is secured against accidentally falling out of the watch part, as for example, may be the case with a screw connection.

Within the scope of the invention various possibilities of alternatives are provided. Thus, the ballpoint pen may be replaced by a felt tip pen or a fountain pen or the like; moreover, the watch may be replaced by any other chronometrical device, for example, a stop watch, whilst the leather thong may be replaced by a plurality of other strips or chains.

What I claim is:

1. A pendant comprising a sleeve, to which a writing implement, more especially, a ballpoint pen may be attached at one end of said sleeve in combination with a timepiece, in which the timepiece has a housing which, by means of a plurality of locking detents having gaps therebetween, is removably connected to the sleeve, wherein one of said gaps between the locking detents is wider than the others of said gaps and in which a projection is provided in the sleeve, a clip disposed in said projection, and in which the sleeve has two opposed apertures for pulling through a necklace-type strip and in which the wider gap and the apertures for the necklace-type strip are so arranged that the timepiece, when worn around the neck, is readable.

2. A pendant as claimed in claim 1, in which the housing of the timepiece has four locking detents and the said wider gap is formed opposite the winder of the timepiece located at 12 o'clock and in which the sleeve is provided with a locking bead.

3. A pendant as claimed in claim 1, in which said clip is slightly countersunk in said projection of the sleeve, so that between the upper part of the clip and the lower edge of the housing a gap remains for removing the timepiece from the sleeve.

4. A pendant as claimed in claim 1, in which the sleeve, in the lower half thereof and at its lower end, has an encircling projection in order to receive the end of the tip of the writing implement.

5. A pendant as claimed in claim 1, in which the apertures for the strip are formed at right angles to the connecting line between the winder and the wider gap.

6. A pendant as claimed in claim 1, in which the sleeve, on its end serving to receive the writing implement, has an encircling groove into which a polygonal spring is inserted.

7. A pendant as claimed in claim 6, in which the spring is hexagonal and open.

* * * * *